United States Patent [19]

Mihalcheon

[11] 4,115,900

[45] Sep. 26, 1978

[54] HINGE AND ROLLER SUPPORT DEVICE FOR SECTIONAL DOOR

[76] Inventor: Arthur Mihalcheon, 74 Valleyview Crescent, Edmonton, Alberta, Canada

[21] Appl. No.: 714,303

[22] Filed: Aug. 16, 1976

[51] Int. Cl.[2] ..... E05D 15/04

[52] U.S. Cl. ..... 16/104; 160/209

[58] Field of Search ..... 16/97, 104, 106, 179, 16/DIG. 1; 160/201, 209

[56] References Cited

U.S. PATENT DOCUMENTS

| | | | |
|---|---|---|---|
| 1,857,756 | 5/1932 | Headley | 16/97 |
| 2,040,080 | 5/1936 | Collins | 160/209 X |
| 2,655,683 | 10/1953 | McKee et al. | 160/209 X |
| 2,703,141 | 3/1955 | McKee | 16/97 X |
| 3,376,913 | 4/1968 | Clapsaddle | 16/97 X |

*Primary Examiner*—Werner H. Schroeder
*Assistant Examiner*—Moshe I. Cohen
*Attorney, Agent, or Firm*—Ernest Peter Johnson

[57] ABSTRACT

In a device of this type, the tubular member which receives the track roller shaft is attached to the door plate supporting ears by an arm which is bolted to the ears. Thus the tubular member can be rotated about the bolts to adjust its distance from the hinge plates. As a result, an adjustable unit is provided which is easy to install and set.

1 Claim, 3 Drawing Figures

2
4
14
11
7
8
6
1
13
3
11
4
2

16
15
1
6
7
12
11
1
8
11
10
12
2
13
5
3
4
14
5
14
13
2
4

1
1

HINGE AND ROLLER SUPPORT DEVICE FOR SECTIONAL DOOR

BACKGROUND OF THE INVENTION

This invention relates to a hinge and roller support device for a sectional door.

In the assembly of a sectional door, the door sections are connected together by vertically positioned hinge plates spaced along the side edge portions thereof. Since the door slides along spaced tracks mounted on the building, it is conventional to mount a roller on each hinge plate to connect the track and door sections.

Now the rising leg of each track is slightly inclined away from the door jamb. Therefore it is necessary that the rollers of successive hinge assemblies be spaced further and further away from the attached hinge plates, so that the door sections adopt a vertical position when closing the door opening.

Heretofore the hinge and roller support devices used in industry have tended to be of two types. One type can be said to have a fixed bearing for receiving the roller and the other has a bearing whose position relative to the hinge plates can be adjusted. Both types comprise a pair of plates hinged together end to end.

In the case of the first type, a pair of spaced, upstanding, apertured ears extend outwardly from the side edges of one of the hinge plates. A horizontal tube extends through the apertures and is fixed to the ears to provide a stationary bearing for the roller shaft. A shortcoming of this type of device is that each of the required units at the section junctures are different — each must have its tube spaced outwardly from the plates a different distance when compared to its neighbors. Therefore it is necessary to keep in stock a different unit for each section junction of the door to be installed.

To overcome this difficulty, an adjustable device has been marketed which involves forming one of the vertical hinge plates to provide an outwardly extending bracket having a transverse, horizontal wall. Outwardly directed parallel slots are provided in this horizontal wall. A separate bearing member is then slidably mounted on the bracket. Bolts are inserted through the slots and apertures and nuts are threaded thereon to clamp the tongue portion of the bearing member to the bracket wall at the desired location.

This unit also has shortcomings. More particularly, it is expensive to construct and is difficult to install, as the nuts and bolts have to be tightened from above and below under cramped conditions.

SUMMARY OF THE INVENTION

Turning now to the present invention, it comprises the usual hinged plates and a pair of upstanding bearing support ears extending outwardly from one of the plates. A bearing member is provided comprising a tubular support portion, for receiving the shaft of a roller, and an arm portion. Means for disengagably connecting and locking the end of the arm portion, remote from the support portion, to the support ears is provided. Thus the arm can be rotated about its connection with the ears, to vary the distance of the support portion relative to the plates, and then be locked in place to fix the position of the roller relative to the sectional door.

DESCRIPTION OF THE DRAWING

Turning now to the drawing.

PREFERRED EMBODIMENT

Figure 1:
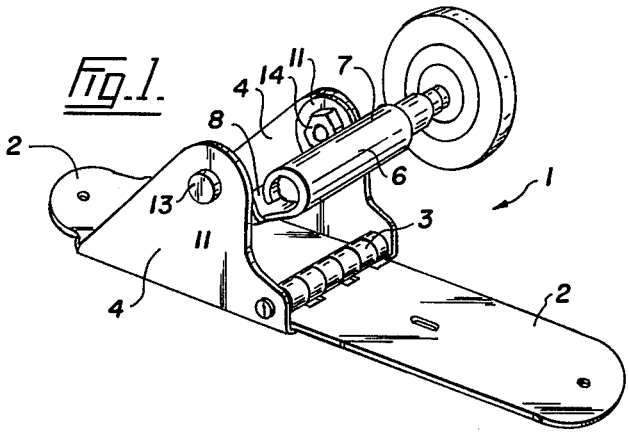
FIG. 1 is a perspective view of the device.
Figure 2:
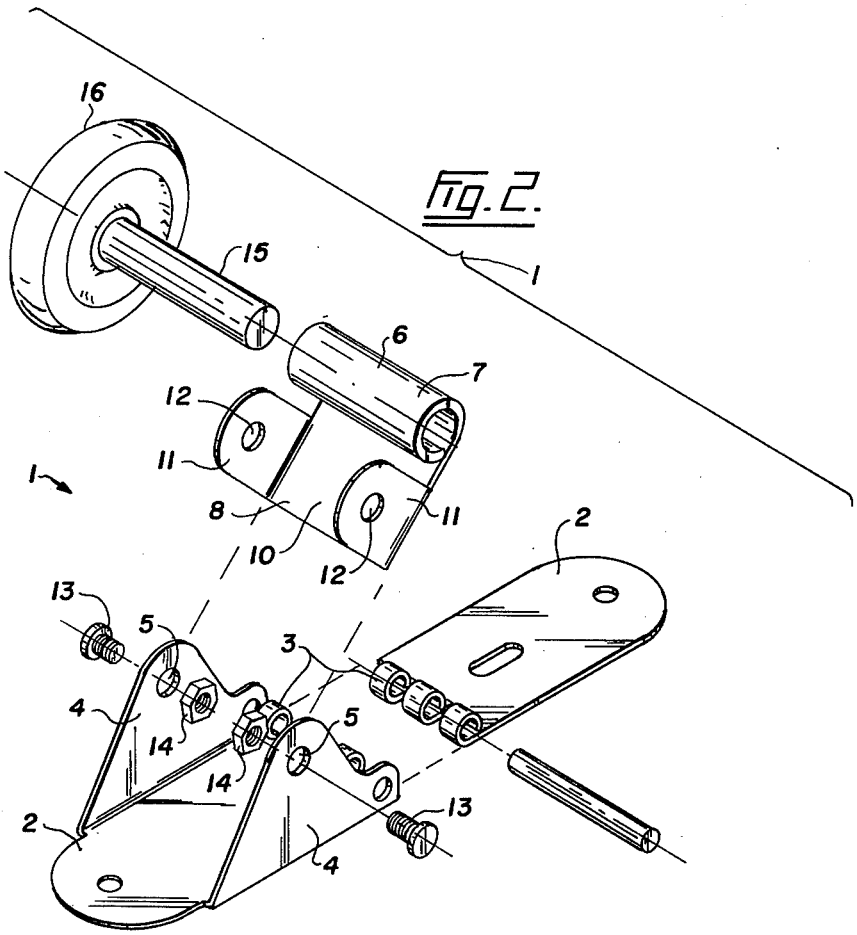
FIG. 2 is an exploded view similar to that of FIG. 1.
Figure 3:
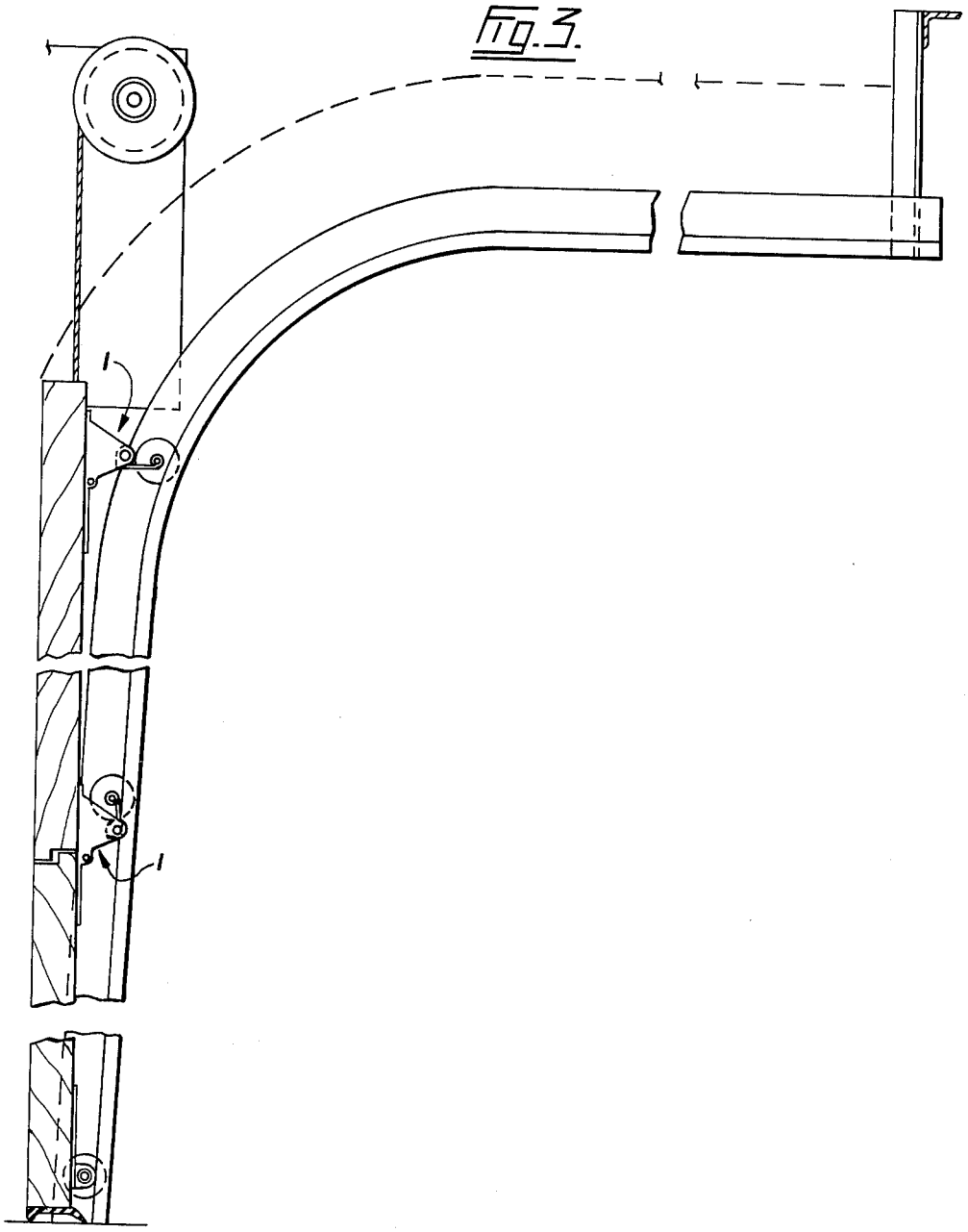
FIG. 3 is a partial side view showing part of a door, a track and the invention in place connecting them.

With reference to the drawing, the hinge and roller support device 1 comprises a pair of door plates 2 connected end to end by a hinge 3. A pair of upstanding spaced bearing support ears 4 extend from one of the plates. Transverse bolt-receiving apertures 5 extend through the upper parts of the ears.

The Bearing Member

A bearing member 6 is provided comprising a tubular support portion 7 and an arm portion 8. The tubular support portion 7 is adapted to receive the shaft 15 of a roller 16. The arm portion 8 comprises a tongue 10, extending from the tubular support portion 7, and a pair of lugs 11 upstanding from the side edges of the tongue 10. The lugs 11 have apertures extending transversely therethrough.

Means for Connection and Locking

Threaded bolts 13 may be provided to extend through the adjacent apertures 5, 12 when the lugs 11 are positioned between the support ears 4. The bolts 13 function to interconnect the bearing member 6 and the support ears 4 and serve as a pivot point about which the arm portion 8 can be rotated to adjust the position of the tubular support portion 7 relative to the door plates 2. Nuts 14 are threaded onto the bolts 13 to clamp the lugs 11 to the support ears 4 and lock the bearing member 6 in place.

The main advantages of the unit are that: (1) the tubular support portion 7 can easily and accurately be positioned by rotating it; and (2) the nuts are readily accessible and can easily be tightened to quickly clamp the bearing member 6 into place. The unit is relatively inexpensive and easy to install.

It will be readily understood that minor changes in the size, form and construction of the various elements of the described unit may be made and substituted for those herein shown and described, without departing from the spirit of the invention, the scope of which is set forth in the appended claims.

The embodiments of the invention in which an exclusive property or privilege is claimed are defined as follows:

1. A hinge and roller support device for a sectional door, comprising:

a pair of plates hinged together end to end and adapted to be attached to the door;

one of the plates having a pair of spaced bearing support ears upstanding therefrom, each ear forming a transverse bolt-receiving aperture spaced above the plate;

a bearing member comprising a tubular support portion, for receiving the shaft of a roller, and an arm portion of generally right-angled configuration and extending from the support portion, said arm portion comprising a tongue portion, extending from the tubular support portion, and a pair of spaced apertured lugs projecting from the side edges of the tongue portion at its end remote from the tubular support portion, said lugs forming said right angles with the tongue portion, whereby, when the elements are assembled, the apertures of the lugs are located adjacent to and in alignment with the ear apertures;

threaded bolt means for connecting the support ears and the lugs by extension through the adjacent pairs of apertures; and nut means threadable on the bolt means for disengagably locking the bearing member to the support ears;

whereby the arm portion can be rotated about the bolt means to vary the distance of the tubular support portion from the plates and then be fixed in place by tightening only the bolt and nut means recited.

* * * * *